US010950965B2

(12) United States Patent
Annecke et al.

(10) Patent No.: US 10,950,965 B2
(45) Date of Patent: Mar. 16, 2021

(54) CONTACT ELEMENT ARRANGEMENT

(71) Applicant: Amphenol-Tuchel Electronics GmbH, Heilbronn (DE)

(72) Inventors: Alfred Annecke, Heilbronn (DE); Claus Dullin, Bad Rappenau-Fürfeld (DE)

(73) Assignee: Amphenol-Tuchel Electronics GmbH, Heilbronn (DE)

( * ) Notice: Subject to any disclaimer, the term of this patent is extended or adjusted under 35 U.S.C. 154(b) by 0 days.

(21) Appl. No.: 16/609,052

(22) PCT Filed: Apr. 27, 2018

(86) PCT No.: PCT/EP2018/060906
§ 371 (c)(1),
(2) Date: Oct. 28, 2019

(87) PCT Pub. No.: WO2018/197682
PCT Pub. Date: Nov. 1, 2018

(65) Prior Publication Data

US 2020/0099155 A1 Mar. 26, 2020

(30) Foreign Application Priority Data

Apr. 28, 2017 (DE) ..... 10 2017 109 246.3

(51) Int. Cl.
*H01R 13/11* (2006.01)
*H01R 13/703* (2006.01)
*H01R 13/41* (2006.01)

(52) U.S. Cl.
CPC ..... *H01R 13/111* (2013.01); *H01R 13/112* (2013.01); *H01R 13/7033* (2013.01); *H01R 13/41* (2013.01); *H01R 2201/26* (2013.01)

(58) Field of Classification Search
CPC . H01R 13/111; H01R 13/112; H01R 13/7033; H01R 13/41; H01R 2201/26;
(Continued)

(56) References Cited

U.S. PATENT DOCUMENTS 6,964,579 B2 * 11/2005 Seminara ..... F42B 3/26 439/188
7,445,518 B2 * 11/2008 Schneider ..... H01R 13/2428 439/700

(Continued)

FOREIGN PATENT DOCUMENTS

DE 10 2009 053 052 A1 5/2011
EP 3 118 943 A1 7/2015

(Continued)

*Primary Examiner* — Travis S Chambers
(74) *Attorney, Agent, or Firm* — Blank Rome LLP

(57) ABSTRACT

The invention relates to a contact element arrangement consisting of a shaped sheet metal part, wherein at least two contact elements, which are spaced apart from each other and extend away from a flat base plate of the sheet metal part, are shaped from the sheet metal part and wherein the one contact element forms a substantially cylindrical contacting portion for mounting a pin-shaped counter contact by insertion and wherein the second contact element is formed as a contact spring bent in an S-shape over two bending portions, the contact spring forming a contact point facing away from the base plate.

13 Claims, 3 Drawing Sheets

Figure 1:
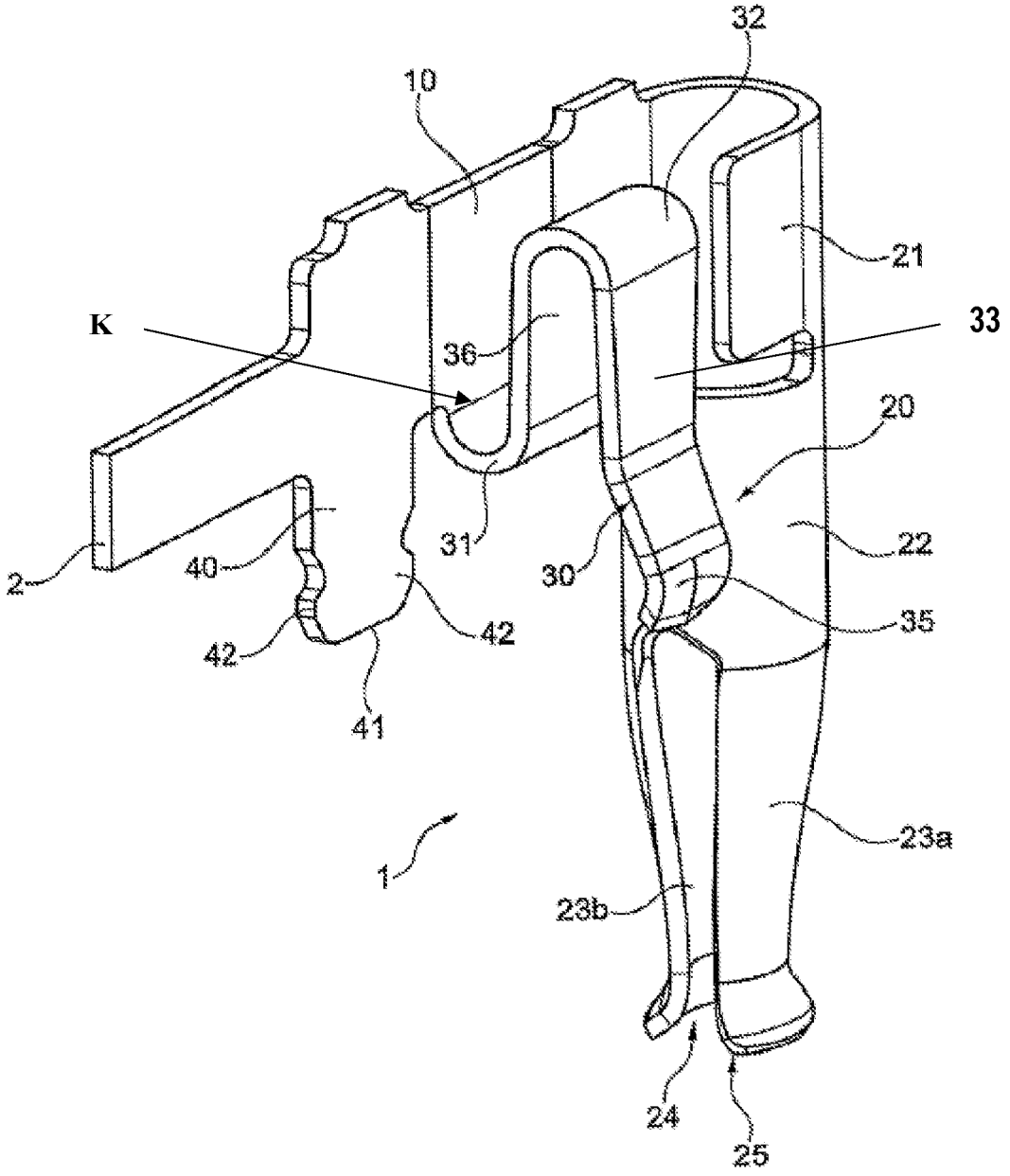

(58) Field of Classification Search
CPC ..... H01R 13/2428; H01R 13/2442; H01R 11/05; H01R 43/16; H01R 13/703; H01R 13/032; H01R 31/08
USPC ..... 439/889, 188, 507–514
See application file for complete search history.

(56) References Cited

U.S. PATENT DOCUMENTS

| | | | | |
|---|---|---|---|---|
| 2004/0157494 | A1* | 8/2004 | Williamson | H01R 13/7195 439/620.07 |
| 2015/0111400 | A1* | 4/2015 | Hashiguchi | H01R 12/714 439/66 |

FOREIGN PATENT DOCUMENTS

| | | | |
|---|---|---|---|
| EP | 3 116 075 | A1 | 1/2017 |
| EP | 2 440 433 | B1 | 4/2017 |
| WO | WO 2011/161756 | | 12/2011 |

* cited by examiner

CONTACT ELEMENT ARRANGEMENT

RELATED APPLICATIONS

This application is a national stage application of International Application No. PCT/2018/060906, filed Apr. 27, 2018, which is related to and claims priority to German Patent Application No. 10 2017 109 246.3, filed Apr. 28, 2017, the entire disclosures of which are hereby incorporated by reference.

The invention relates to a contact element arrangement according to the characteristics of claim 1.

Moreover, the present invention relates to a connector plug, preferably an airbag connector plug with two contact element arrangements according to the present invention.

In the field of plug connectors, in particular of airbag plug connectors, it is known that, for safety reasons, the two contacts of the airbag plug remain in a short circuit position whilst the airbag connector plug is not yet in the fully locked position, that is, they are connected via a short circuit bridge to prevent an unintended ignition of the airbag.

Short circuit bridges in the field of airbag plug connectors are known in many different designs. Nevertheless, the known solutions have a number of production-related disadvantages. Furthermore, certain spring characteristics of such short circuit springs must be ensured when installed.

Thus it is necessary, for example, to provide a sufficiently soft spring contact whilst optimizing the production in the electroplating process through an advantageous position by way of forward displacement of the contact point to be plated on the contact strip. Forward displacement in the context of the present invention means the spatial placement of the contact point into a position that is more favorable for the electroplating process.

The following design objectives must now be met:

- A soft spring characteristic of the contact arm, which serves the production of the short circuit bridge, is required;
- Moreover, strain relief of the clamping location of the contact arm in the housing of the airbag connector plug is to be provided to achieve a reduction in creep of the "plastic material" in the plastic housing;
- The establishing of the electrical contact is to be improved;
- The production-related tolerances should have a reduced effect during installation.

Furthermore, there are also production engineering-related objectives to be met, that is, a simpler plating of the contact points or contact point, which later forms the electrical contact with a corresponding counter-contact element to establish the short circuit of the short circuit bridge.

It is also necessary to reduce production-related costs and to avoid intensive and expensive masking processes for electroplating.

Moreover, carryover of the electroplating to areas that are not to be plated, that is, areas that are to remain uncoated, is to be avoided so that said areas can later be used as weld connection points for welding on electrical conductors.

The implementation of the aforementioned objectives is achieved with a contact element arrangement according to the characteristics of claim 1.

The basic concept of the present invention is to provide a specifically formed contact element arrangement that is produced from a single sheet metal part.

Thus, according to the invention, a contact element arrangement is provided that consists of a deformed sheet metal part, wherein at least two contact elements spaced apart from each other are formed from the sheet metal part, which extend away from a flat base plate from the sheet metal part and wherein the one contact element forms an essentially cylindrical contacting portion for the insertion assembly of a pin-like counter contact (of the airbag plug) and wherein the second contact element is provided as an S-shaped contact spring formed via two bending portions that forms a contact point that points away from the base plate.

If two of such contact element arrangements according to the invention are fitted diametrically opposed in the contact carrier, for example in that of an airbag plug, in such a manner that the contact points face each other and make contact, it is possible to realize a short circuit bridge with simple and cost-effective means.

In a further advantageous embodiment of the invention provision is made that the first bending portion of the contact spring is located directly next to a lateral edge of the base plate or extends away from the same respectively.

In an also advantageous embodiment of the invention provision is made that the second bending portion of the contact spring is located laterally offset within the outline contour of the base plate.

This means in other words that, in the instance of a contact lying down, the second bending portion is located as it were above the base plate and not outside the contour of the base plate.

This has the advantage of a very compact design wherein, due to the spring arm being bent in an S-shape, there is still a correspondingly long and soft spring arm provided. Through the overall equally S-shaped design of said spring arm a contact is formed that is also compact in height without losing in required spring arm length.

It is also advantageous if a spring arm portion of the spring arm follows the second bending portion that is longer than the width of the base plate in the section in which the spring arm is attached to the base plate. This causes the crest of the spring to protrude, as it were, from the contour section of the base plate.

In a further advantageous embodiment provision is made that the spring arm extends directly away from a lateral edge of the base plate. This means that the first bending portion is formed directly in one piece as it were with the base plate and that a connecting portion to the second bending portion is located in between and a spring arm portion follows the second bending portion.

In an advantageous embodiment the spring arm is provided at each bending portion with a change in direction of approximately 180°, which establishes said S-shaped bending curve of the spring arm. In other words, each of the bending portions constitutes a spring arm portion that is bent 180°.

Provision is made in an also advantageous embodiment of the invention that the first contact element is provided with at least two spring arms at its plug end that are oriented with respect to each other so that they form a receiving space for accepting a pin contact.

This means, in other words, that the two spring arms span an approximately cylindrical envelope curve as it were and are correspondingly bent so that the first contact element forms an essentially cylindrical receiving section for a pin contact.

Provision is made, furthermore, that the two spring arms of the first contact element converge with their ends towards each other so that the two spring arms have a smaller distance to each other in the section of the plug end or adjacently than in the section that is located further away, that is, in the section closer to the connection to the contacting portion, which is shaped cylindrically.

Advantageous provision is made, furthermore, if a support web extends also away from the lateral edge of the base plate to facilitate the mounting or attachment of the contact element arrangement in a contact body.

It is again advantageous if the first and the second contact element and the support web all extend away from the base plate in essentially the same direction.

Thus the extension direction of the first contact element is hereafter also called plug direction and the extension direction of the support web is called attachment direction. The plug direction and the attachment direction therefore extend essentially parallel to each other.

It is also advantageous if the first and second contact element and the support web are attached to the base plate in series side by side in the said order.

In a further advantageous embodiment of the invention provision is made that the first contact element forms also a tulip-shaped opening at its plug end, which is achieved in that the spring arms are bent slightly outwards.

A further aspect of the invention is an assembly of two contact element arrangements that are fitted next to each other in a contact carrier in such a way that the contact points of the two contact element arrangements face each other.

A further aspect of the invention is a connector plug, preferably an airbag connector plug, disposed in which is a contact carrier in which two contact element arrangements according to one of the claims 1 to 12 are mounted.

Figure 2:
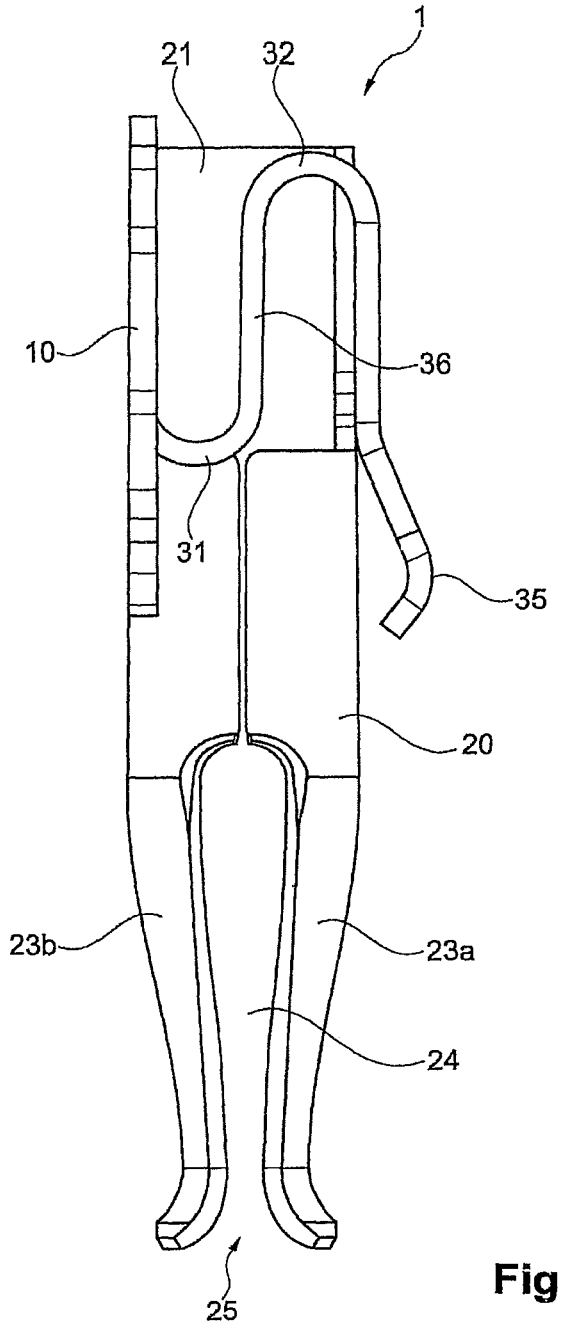
Figure 3:
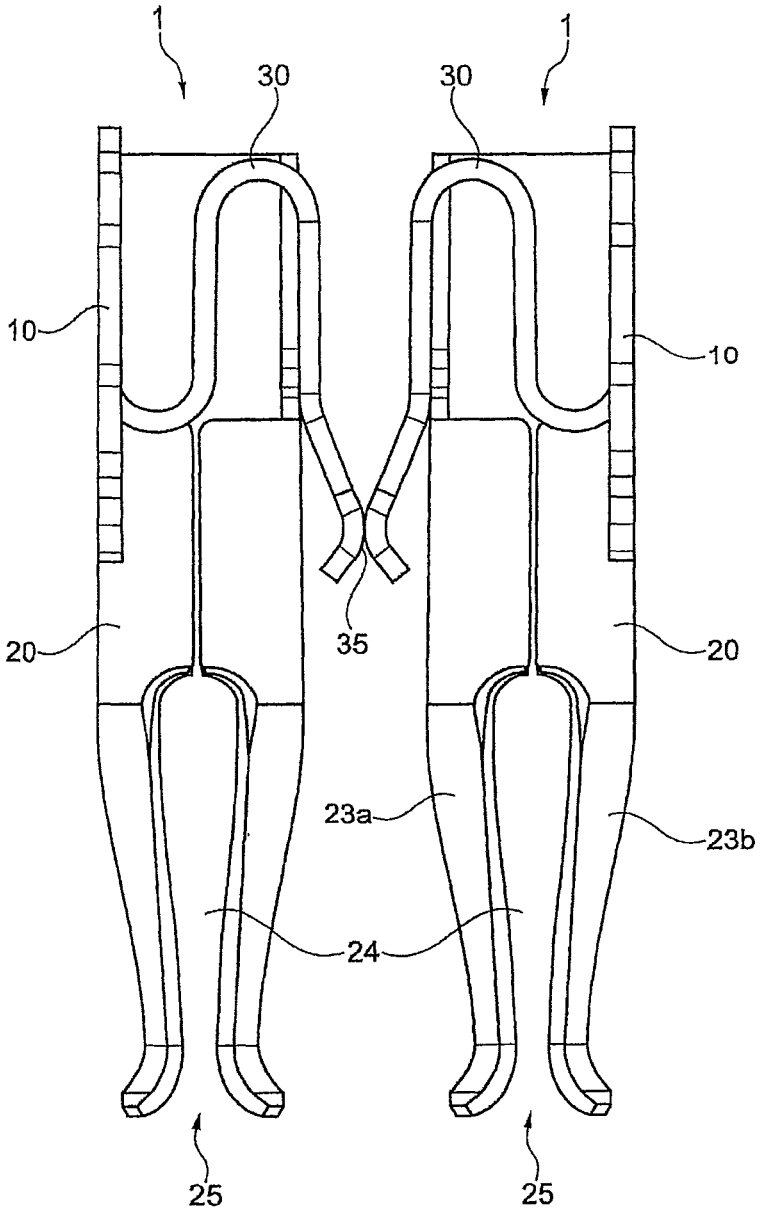

Further embodiments of the invention become apparent from the claims as well as the drawings and the corresponding drawing description, wherein the drawings depict the following:

FIG. 1 a perspective view of an exemplary embodiment of a contact element arrangement;

FIG. 2 a side elevation of the contact element arrangement in FIG. 1;

FIG. 3 a side elevation of two contact element arrangements according to FIG. 1 whilst forming a short circuit bridge.

The following describes the invention in greater detail with reference to FIGS. 1 to 3, wherein the same reference numbers point to the same structural and/or functional characteristics.

FIGS. 1 to 3 depict an exemplary embodiment of a contact element arrangement 1 according to the invention. The contact element arrangement 1 is formed from a sheet metal part 2. Said sheet metal part 2 was shaped in such a way that two from each other separated contact elements 20, 30 are formed therefrom, which extend away from a flat base plate 10 of the sheet metal part 2 and wherein the contact element 20 forms an essentially cylindrical contacting portion 22 for a plug assembly of a pin-like counter contact that is not shown in detail.

Located beside it is the second contact element 30, which is formed into an S-shaped contact spring via two bending portions 31, 32. Moreover, the contact spring forms a contact point 35, which in its orientation points away from the base plate 10.

As is clearly apparent from FIG. 1, the contact spring is provided with the aforementioned two bending portions 31, 32, wherein the first bending portion 31 extends directly from the lateral edge K of the base plate 10.

Formed onto the second bending portion 32 is a spring arm portion 33 of the spring arm 20, which in its length, however, is longer than the width of the base plate 10 in the section in which the spring arm 30 is attached to base plate 10. Thus the spring arm 20 protrudes downwards to such an extent that the contact point 35 is disposed outside the outline contour of base plate 10. A linear portion 36 is disposed between the first bending portion 31 and the second bending portion 32.

The first contact element 20 forms an approximately U-shaped bending portion 21. Located beside the U-shaped bending portion 21 is the aforementioned contacting portion 22 of the first contact element 20 from which extend two spring arms 23*a*, 23*b* that are oriented to each other in such a way that a receiving space 24 is formed in between, which serves to receive a pin contact of a counter plug.

As becomes further apparent from the figures, the spring arms 23*a*, 23*b* form at the end an approximately tulip-shaped opening 25.

It is, moreover, apparent from FIGS. 1 to 3 that the contact element arrangement 1 is provided with a support web 40, which also extends away from base plate 10 for the purpose of attaching the contact element arrangement 1 in a contact body of a connector plug. The support web 40 is provided at its plug end 41 with a lobe 42 on the one and on the opposite side each so that it catches in the plastic material of a contact carrier.

It is, moreover, apparent that the two contact elements 20, 30 and the support web 40 all extend essentially in the same direction away from base plate 10, that is, in the aforementioned plug direction, wherein the second contact element is provided in between with an S-shaped bending curve.

FIG. 3 depicts an arrangement of two contact element arrangements 1, in which their contact points 35 make contact and forma short circuit bridge.

A primary locking mechanism with release arm is moveably disposed inside the connector plug. By operating the release arm and moving it between the two contact points 35 the spring arms are moved outwards and the electrical contact between the contact points 35 is interrupted.

This makes it possible to provide a cost-effective and easy to install solution of contact elements for an airbag connector plug.

The invention is not limited in its embodiment to the above-described preferred exemplary embodiments. Rather, a number of variations is conceivable which make use of the described solution even with fundamentally differently designed embodiments.

LIST OF REFERENCE NUMBERS

1 Contact element arrangement
2 Sheet metal part
10 Base plate
20 First contact element/contact spring
21 Bending portion
22 Contacting portion
23*a*, 23*b* Spring arms
24 Receiving space
25 Opening
30 Second contact element/contact spring
31 First bending portion
32 Second bending portion
33 Spring arm portion
35 Contact point/linear portion
36 Contact point
40 Support web
41 Plug end
42 Lobe
K Lateral edge

The invention claimed is:

1. A contact element arrangement comprising:

a deformed sheet metal part, wherein at least first and second contact elements spaced apart from each other are formed from the sheet metal part and extend away from a substantially flat base plate of the sheet metal part, wherein the first contact element forms an essentially cylindrical contacting portion for a plug assembly with a counter contact, and wherein the second contact element is a generally S-shaped contact spring formed via first and second bending portions each with a change in direction of approximately 180 degrees, and a linear portion between the first and second bending portions, and the second contact element forms a contact point that faces away from the base plate.

2. The contact element arrangement according to claim 1, wherein the first bending portion of the second contact element is located next to a lateral edge of the base plate.

3. The contact element arrangement according to claim 1, wherein said second bending portion of the second contact element is located laterally offset within an outline contour of the base plate.

4. The contact element arrangement according to claim 1, wherein a spring arm portion of the second contact element follows the second bending portion such that the spring arm portion is longer than a width of the base plate in a section in which the second contact element is attached to the base plate.

5. The contact element arrangement according to claim 1, wherein the second contact element extends away from a lateral edge of the base plate.

6. The contact element arrangement according to claim 1, wherein the first contact element is provided with an approximately U-shaped bending portion.

7. The contact element arrangement according to claim 1, wherein the first contact element forms at a plug end thereof a tulip-shaped opening.

8. The contact element arrangement according to claim 1, wherein the contact element arrangement is positioned next to another contact element arrangement so that the contact points of the two contact element arrangements face each other.

9. The contact element arrangement according to claim 1, wherein the first contact element is provided with at least two spring arms at a plug end that are oriented with respect to each other to form a receiving space for accepting the counter contact.

10. The contact element arrangement according to claim 9, wherein the two spring arms of the first contact element have a smaller distance therebetween at the plug end than at a connection to the contacting portion.

11. The contact element arrangement according to claim 1, wherein a support web extends away from the lateral edge of the base plate to attach the contact element arrangement in a contact body.

12. The contact element arrangement according to claim 11, wherein the first and the second contact elements and the support web all extend away from the base plate in essentially the same direction.

13. The contact element arrangement according to claim 11, wherein the first and second contact elements and the support web are attached to the base plate in series side by side arrangement.

* * * * *